United States Patent [19]

Shelley

[11] Patent Number: 4,957,260

[45] Date of Patent: Sep. 18, 1990

[54] UNITARY MOUNTING BRACKET FOR PRESSURIZED CONTAINERS

[76] Inventor: William F. Shelley, 14 Logwood Cir., Essex Junction, Vt. 05452

[21] Appl. No.: 394,712

[22] Filed: Aug. 16, 1989

[51] Int. Cl.[5] ..... A47K 5/00

[52] U.S. Cl. ..... 248/311.3; 141/352; 141/362; 222/181

[58] Field of Search ..... 248/311.2, 311.3, 313; 141/360, 361, 362, 354, 352; 222/181

[56] References Cited

U.S. PATENT DOCUMENTS

| | | | |
|---|---|---|---|
| 2,056,096 | 9/1936 | Etter | 221/62 |
| 2,128,488 | 8/1938 | Koerner | 222/181 X |
| 2,172,521 | 9/1939 | Shoner | 221/102 |
| 2,389,683 | 11/1945 | Page | 222/126 |
| 2,556,826 | 6/1951 | Stone | 141/360 |
| 2,678,755 | 5/1954 | Buras | 222/103 |
| 2,775,989 | 1/1957 | Jensen | 141/360 |
| 2,942,631 | 6/1960 | Biewald | 141/360 |
| 2,948,308 | 8/1960 | Regina | 141/362 |
| 3,096,913 | 7/1963 | Corley | 222/183 |
| 3,589,338 | 6/1971 | Levitz | 119/51 |
| 4,164,306 | 8/1979 | Perrin | 222/181 |
| 4,429,812 | 2/1984 | Steiner et al. | 222/181 |
| 4,650,095 | 3/1987 | Tella et al. | 222/153 |
| 4,778,084 | 10/1988 | Chen et al. | 222/181 X |
| 4,784,360 | 11/1988 | Mok | 248/313 |

*Primary Examiner*—David L. Talbott

[57] ABSTRACT

A unitary mounting bracket for a gas-pressurized canister. The canister includes a paste to be dispensed onto an elongated object, and at its top end includes an elongated nipple actuator extending along the longitudinal axis of the canister. Movement of the actuator causes the paste to be dispensed from the tip of the actuator. The bracket has an elongated base which extends along a first longitudinal axis and has a spring portion and a pair of arms to support the canister along a second longitudinal axis parallel to the first longitudinal axis. The bracket also has a ring portion connected by a flexible arm to the base at a point below the arms. The ring portion defines an aperture which is disposed along the second longitudinal axis and the nipple actuator extends through the aperture when the canister is positioned in the base. The flexible arm is constructed to allow movement of the ring portion in a direction from the second longitudinal axis to the first longitudinal axis, and to allow the part of the ring portion to contact and move the nipple actuator and thereby cause the paste to be dispensed from the tip of the actuator. Finally the bracket has a wall fixedly connected to the flexible arm below the ring portion which is constructed to allow the elongated object to contact and move the wall to cause the ring portion to contact and move the nipple actuator to cause dispensing of the paste.

6 Claims, 2 Drawing Sheets

UNITARY MOUNTING BRACKET FOR PRESSURIZED CONTAINERS

BACKGROUND OF THE INVENTION

This invention concerns brackets suitable for mounting pressurized containers. One example of such a bracket (Biewald, U.S. Pat. No. 2,942,631) is an adapter for a pressurized container containing a paste-like composition, such as toothpaste. The container is mounted to a wall bracket, and a separate actuator assembly unit mounted on the neck of the container. The actuator unit includes an adaptor which forms a cap to engage the neck of the container with a tight fit.

SUMMARY OF THE INVENTION

In a first aspect, the invention features a unitary mounting bracket for a gas-pressurized canister. The canister includes a paste to be dispensed onto an elongated object, and at its top end includes an elongated nipple actuator extending along the longitudinal axis of the canister. Movement of the actuator from the axis causes the paste to be dispensed from the tip of the actuator. At the other end the canister includes a base having a circular ridge. The bracket has an elongated base having at least one planar surface adapted for fixation to a flat surface. The base extends along a first longitudinal axis, having at one portion of the first longitudinal axis a spring portion constructed and arranged to mate with the circular ridge of the canister base. At another portion of the first longitudinal axis the bracket has a pair of arms extending approximately perpendicular to the first longitudinal axis, the arms being spaced apart along the base a distance sufficient to allow the nipple actuator to pass therebetween while the arms support the top end of the canister. The arms cooperate with the spring portion to fixedly hold the canister between the arms and the spring portion along a second longitudinal axis parallel the first longitudinal axis. The canister can be readily removed and replaced from between the arms and the spring portion. The bracket also has a ring portion fixedly connected by a flexible arm to the base at a point below the arms. The ring portion defines an aperture which is disposed along the second longitudinal axis. The flexible arm extends at an acute angle from the base below the arms to the ring portion, and the nipple actuator extends through the aperture of the ring portion along the second longitudinal axis when the canister is fixedly positioned in the base. The nipple actuator is near or adjacent a part of the ring portion positioned furthest from the first longitudinal axis. The flexible arm is constructed and arranged to allow movement of the ring portion in a direction from the second longitudinal axis toward the first longitudinal axis, and to allow the part of the ring portion to contact and move the nipple actuator, and thereby cause paste to be dispensed from the tip of the actuator. Finally, the bracket has a wall fixedly connected to the flexible arm below the ring portion, extending in a direction parallel to and spaced from the first longitudinal axis. The wall is constructed and arranged to allow the elongated object to contact and move the wall in the direction from the second longitudinal axis toward the first longitudinal axis and thereby cause the ring portion to be moved in the same direction to cause dispensing of the paste.

In a second related aspect, the invention features a unitary mounting bracket for the gas-pressurized canister described above. The bracket has an elongated base having at least one planar surface adapted for fixation to a flat surface. The base extends along a first longitudinal axis having at one portion of the first longitudinal axis a circular clip portion extending in a direction perpendicular to the first longitudinal axis, constructed and arranged to allow the canister to be inserted within the clip portion, and once inserted to hold the canister fixedly in position. At another portion of the first longitudinal axis the bracket has a pair of arms extending approximately perpendicular to the first longitudinal axis, the arms being spaced apart along the base a distance sufficient to allow the nipple actuator to pass therebetween while the arms support the top end of the canister. The arms cooperate with the clamp portion to fixedly hold the canister between the arms and the clamp portion along a second longitudinal axis parallel the first longitudinal axis. The canister can be readily removed and replaced from between the arms and the clamp portion. As is the first aspect, the bracket includes a ring portion and a wall as described above.

In preferred embodiments, the unitary mounting bracket includes a shelf portion projecting perpendicularly to the wall below the ring portion, and passing through the second longitudinal axis; the wall further includes a second shelf located further from the ring portion than the first shelf, the second shelf being parallel to the first shelf and being constructed and arranged to allow the elongated object to be slideably moved along the second shelf; the wall further includes a pair of sidewalls extending from the wall and connecting the first and second shelf to form a box having an opening constructed and arranged to allow the elongated object to be inserted therewithin; and the second elongated object is a toothbrush and the wall is adapted to be moved by insertion of the toothbrush within the wall.

This invention provides a unitary mounting bracket which allows single-handed use of gas-pressurized canisters, for example, for dispensing toothpaste. The bracket allows ready insertion and later removal of the gas-pressurized canister in a position which is always available for immediate use. The unitary design of the bracket provides strength to the structure which thereby has a significant life expectancy. Actuation of the nozzle of the canister to cause dispensing of toothpaste requires only a low amount of pressure to be exerted on the canister during use, and thus ensures that the canister remains in place within the bracket. Thus, inadvertent removal of the canister from the bracket during use is unlikely.

Other features and advantages of the invention will be apparent from the following description of the preferred embodiments thereof, and from the claims.

DESCRIPTION OF THE PREFERRED EMBODIMENTS

The drawings will first briefly be described.

DRAWINGS

STRUCTURE

Figure 2:
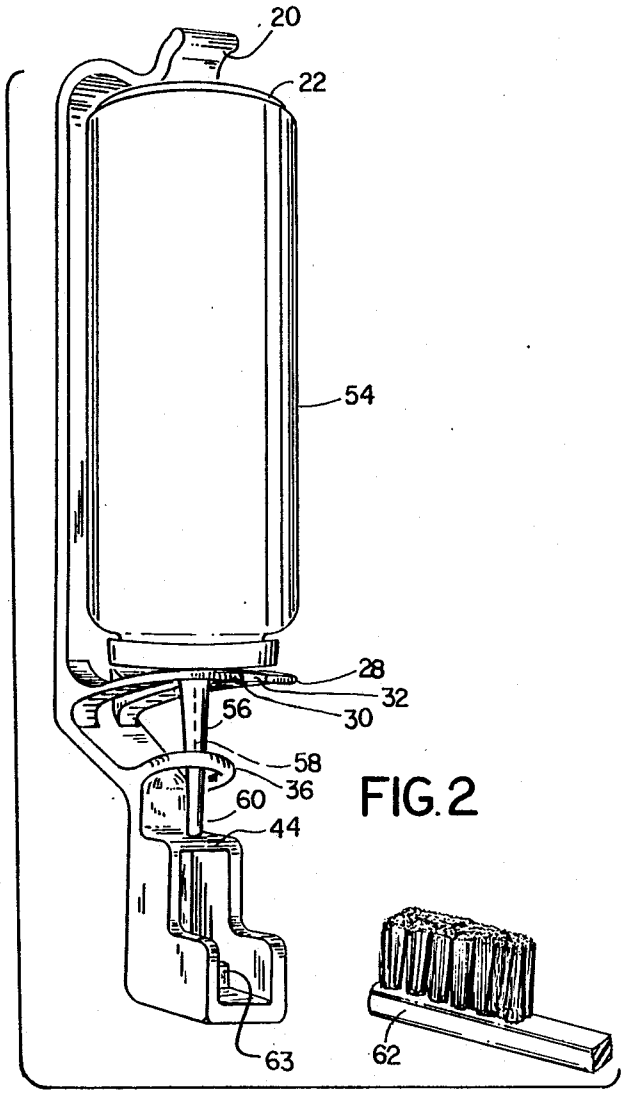
FIG. 2 is an isometric view of the unitary mounting bracket holding a gas-pressurized canister ready for use, with a toothbrush also shown.
Figure 1A:
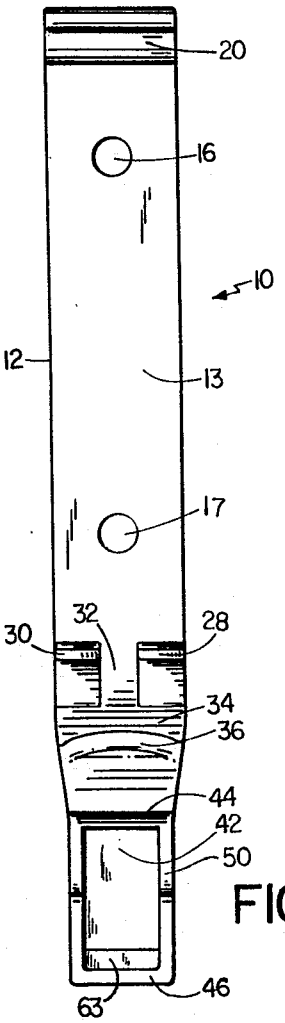
FIGS. 1 and 1A are an isometric view and a front view respectively of a unitary mounting bracket.
Figure 1:
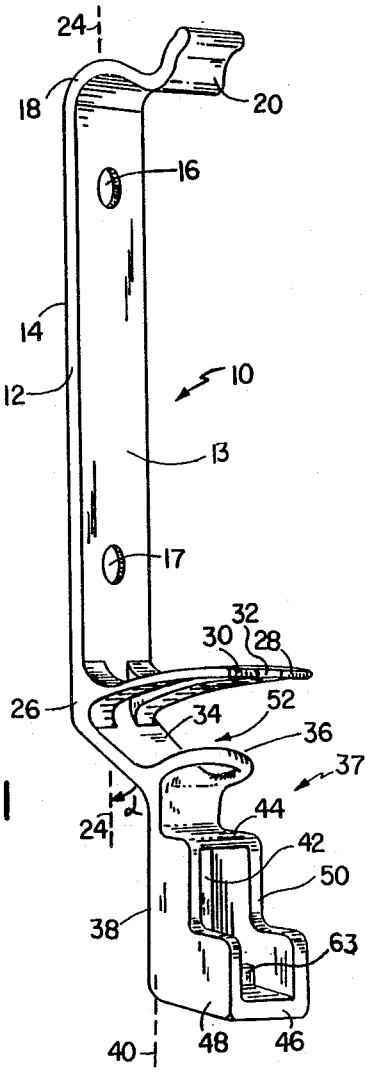

Referring to FIGS. 1, 1A and 2, unitary mounting bracket 10 is formed of stainless steel or suitable plastic material. It consists of an elongated base 12 formed with a rectangular planar mounting portion 13, having a mounting surface 14 with two apertures 16, 17, suitable for insertion of mounting screws (not shown). At its top end 18 the bracket is provided with a resilient spring portion 20 formed to matingly engage a standard circular ridge 22 normally extending about the periphery of the base of a pressurized canister. Base 12 extends along a first longitudinal axis 24. At the lower end 26 of unitary mounting bracket 10 is a pair of elongated arms 28, 30 having a space 32 therebetween. These arms preferably have some resilience to allow cooperation with spring portion 20 in holding a canister. The space between the arms has sufficient width to allow insertion of an elongated nipple actuator 56 of a gas-pressurized canister 54. Spring portion 20 generally normal to mounting portion 13, and arms 28, 30 are slightly raised from the normal to enhance their ability to restrain a canister from being accidentally dislodged once held in the mounting bracket.

Also connected to the lower end of the bracket is a resilient arm 34 extending at an acute angle $\alpha$, of about 45°, from axis 24. At the end of this flexible arm is a ring portion 36, and therebelow a cup 37 having a wall 42 extending along a second longitudinal axis 40 spaced from and parallel to axis 24. Wall 42 is formed of a back wall 38, two shelves 44 and 46, and two sidewalls 48, 50, together forming a recess suitable for insertion of a toothbrush 62. Within this recess is a small rectangular ridge 63, which prevents a toothbrush from being pushed all the way into the recess. Thus, the whole of the toothbrush, when held within the recess, is available for toothpaste to be applied to it. Resilient arm 34 is designed to allow flexing relative to the lower end of the bracket such that angle $\alpha$ decreases. As angle $\alpha$ is decreased the ring portion moves horizontally toward first axis 24, as shown by arrow 52.

Referring to FIG. 2, there is shown a canister 54 mounted between spring portion 20 and arms 28, 30. An elongated nipple actuator 56 of the canister is inserted within space 32, and approximately centrally through ring portion 36. The actuator extends from the canister to touch shelf 44, which acts as a cover for the tip of the actuator. When canister 54 is held in its appropriate location, nipple actuator 56 extends along a third longitudinal axis 58 spaced from and parallel to axes 24 and 40. Tip 60 of the nipple actuator is spaced from the upper top shelf 44.

Figure 3:
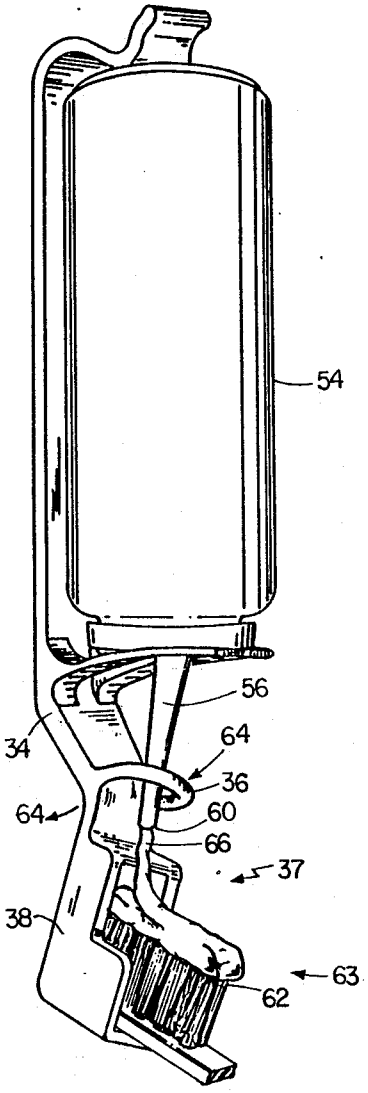
FIG. 3 is an isometric view showing use of the canister shown in FIG. 2.

Referring also now to FIG. 3, a toothbrush 62 is inserted, as shown by arrow 63, into cup 37 against wall 42, thereby causing movement of flexible arm 34 in the direction shown by arrows 64 with concurrent movement of ring portion 36. Upper shelf 44 is thereby moved from below the nipple actuator and then ring portion 36 caused to touch and move nipple actuator 56 and thus cause toothpaste 66 to be dispensed through tip 60 onto the toothbrush. Toothpaste is thus dispensed with a push-pull action of the toothbrush within the cup. The amount of toothpaste deposited depends upon the length of time the brush is pushed into the cup.

OTHER EMBODIMENTS

Figure 4:
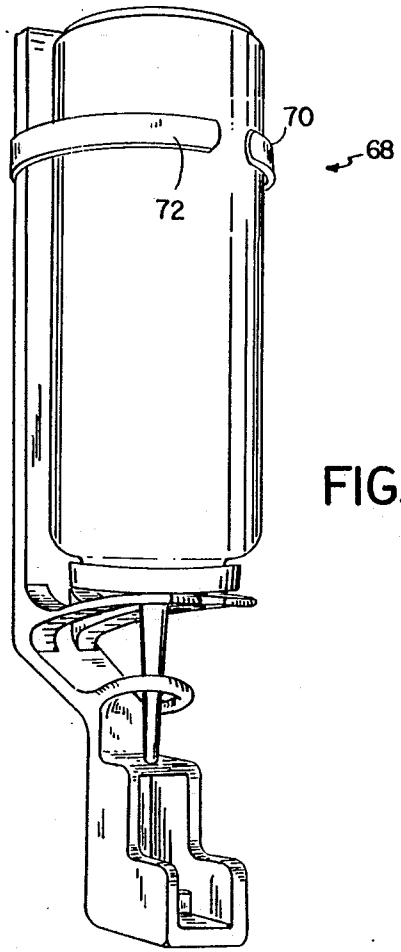
FIG. 4 is an isomeric representation of an alternative mounting bracket of the invention.

Other embodiments are within the following claims. For example, referring to FIG. 4, there is shown a unitary mounting bracket having, in place of a spring portion 20, a clamp 68 formed of two circular arms 70 and 72 forming a circular clip which allow insertion of a canister 54 between them but have sufficient elastic deformation to spring back around canister 54 and hold it fixedly in place.

I claim:

1. A unitary mounting bracket for a gas-pressurized canister comprising a paste to be dispensed onto an elongated object, having at its top end an elongated nipple actuator extending along the longitudinal axis of the canister, wherein movement of the actuator from the axis causes the paste to be dispensed from the tip of the actuator, and at its other end a base having a circular ridge, said bracket comprising:

an elongated base having at least one planar surface adapted for fixation to a flat surface, said base extending along a first longitudinal axis and having at one end portion of said first longitudinal axis a spring portion constructed and arranged to mate with the circular ridge of the canister base, and at another end portion of said first longitudinal axis a pair of arms extending approximately perpendicular to said first longitudinal axis, said arms being spaced apart along said base a distance sufficient to allow the nipple actuator to pass therebetween while said arms support the top end of the canister, wherein said arms cooperate with said spring portion to fixedly hold the canister between said arms and said spring portion, along a second longitudinal axis parallel said first longitudinal axis, and wherein the canister can be readily removed and replaced from between said arms and said spring portion;

a ring portion fixedly connected by a flexible arm to said base at a point below said arms, said ring portion defining an aperture disposed along said second longitudinal axis, said flexible arm extending at an acute angle from said base below said arms to said ring portion; wherein said nipple actuator extends through said aperture of said ring portion along said second longitudinal axis when the canister is fixedly positioned in said base, said nipple actuator being near or adjacent a part of said ring portion positioned furthest from said first longitudinal axis, wherein said flexible arm is constructed and arranged to allow movement of said ring portion in a direction from said second longitudinal axis to said first longitudinal axis and to allow said part of said ring portion to contact and move said nipple actuator and thereby cause paste to be dispensed from the tip of the actuator;

and a wall fixedly connected to said flexible arm below said ring portion and extending in a direction parallel to and spaced from said first longitudinal axis, said wall being constructed and arranged to allow the elongated object to contact and move said wall in said direction from said second longitudinal axis to said first longitudinal axis and thereby cause said ring portion to be moved in said direction to cause dispensing of the paste.

2. A unitary mounting bracket for a gas-pressurized canister comprising a paste to be dispensed onto an elongated object, having at its top end an elongated nipple actuator extending along the central longitudinal axis of the canister, wherein movement of the actuator from the axis causes the paste to be dispensed from the tip of the actuator, said bracket comprising:

an elongated base having at least one planar surface adapted for fixation to a flat surface, said base extending along a first longitudinal axis and having at one portion of said first longitudinal axis a circular clip portion, extending in a direction perpendicular to said first longitudinal axis, constructed and arranged to allow said canister to be inserted within said clip portion, and once inserted to hold said canister fixedly in position, and at another portion of said first longitudinal axis a pair of arms extending approximately perpendicular to said first longitudinal axis, said arms being spaced apart along said base a distance sufficient to allow the nipple actuator to pass therebetween while said arms support the top end of the canister, wherein said arms cooperate with said clamp portion to fixedly hold the canister between said arms and said clamp portion along a second longitudinal axis parallel said first longitudinal axis, and wherein the canister can be readily removed and replaced from between said arms and said clamp portion;

a ring portion fixedly connected by a flexible arm to said base at a point below said arms, said ring portion defining an aperture disposed along said second longitudinal axis, said flexible arm extending at an acute angle from said base below said arms to said ring portion; wherein said nipple actuator extends through said aperture of said ring portion along said second longitudinal axis when the canister is fixedly positioned in said base, said nipple actuator being near or adjacent a part of said ring portion positioned furthest from said first longitudinal axis, wherein said flexible arm is constructed and arranged to allow movement of said ring portion in a direction from said second longitudinal axis, to said first longitudinal axis, and to allow said part of said ring portion to contact and move said nipple actuator and thereby cause paste to be dispensed from the tip of the actuator;

and a wall fixedly connected to said flexible arm below said ring portion and extending in a direction parallel to and spaced from said first longitudinal axis, said wall being constructed and arranged to allow the elongated object to contact and move said wall in said direction from said second longitudinal axis to said first longitudinal axis and thereby cause said ring portion to be moved in said direction to cause dispensing of the paste.

3. The unitary mounting bracket of claim 1 or 2 wherein said wall further comprises a shelf portion projecting perpendicular to said wall below said ring portion and passing through said second longitudinal axis.

4. The unitary mounting bracket of claim 3 wherein said wall further comprises a second shelf located further from said ring portion than said first shelf, said second shelf being parallel to said first shelf and being constructed and arranged to allow the elongated object to be slideably moved along said second shelf.

5. The unitary mounting bracket of claim 4 wherein said wall further comprises a pair of sidewalls extending from said wall and connecting said first and second shelves to form a box having an opening constructed and arranged to allow the elongated object to be inserted therewithin.

6. The unitary mounting bracket of claim 5 wherein said elongated object is a toothbrush and the wall is adapted to be moved by insertion of the toothbrush within said wall.

* * * * *